US008806910B2

(12) United States Patent
Jin et al.

(10) Patent No.: US 8,806,910 B2
(45) Date of Patent: Aug. 19, 2014

(54) METHOD AND APPARATUS FOR REMOVING SCALE FROM HOT-ROLLED STEEL STRIP

(75) Inventors: Young-Sool Jin, Jeollanam-do (KR); Tae-Chul Kim, Jeollanam-do (KR); Soo-Hyoun Cho, Jeollanam-do (KR); Kee-Jo Jeong, Kyungsangbook-do (KR); Young-Ki Lee, Kyungsangbook-do (KR)

(73) Assignee: Posco, Pohang-Si (KR)

( * ) Notice: Subject to any disclaimer, the term of this patent is extended or adjusted under 35 U.S.C. 154(b) by 783 days.

(21) Appl. No.: 13/001,522

(22) PCT Filed: May 19, 2009

(86) PCT No.: PCT/KR2009/002642

§ 371 (c)(1),
(2), (4) Date: Dec. 27, 2010

(87) PCT Pub. No.: WO2010/002103

PCT Pub. Date: Jan. 7, 2010

(65) Prior Publication Data

US 2011/0097973 A1 Apr. 28, 2011

(30) Foreign Application Priority Data

Jul. 4, 2008 (KR) ..... 10-2008-0065157

(51) Int. Cl.
*B21B 45/04* (2006.01)
*B21B 45/06* (2006.01)

(52) U.S. Cl.
CPC ..... *B21B 45/06* (2013.01)
USPC ..... 72/40; 72/39; 72/366.2; 29/81.03; 29/81.12

(58) Field of Classification Search
USPC ..... 72/39, 40, 197, 199, 252.5, 365.2, 72/366.2, 127, 190, 196, 205, 234; 29/81.03, 81.12
See application file for complete search history.

(56) References Cited

U.S. PATENT DOCUMENTS

| | | | | |
|---|---|---|---|---|
| 3,888,048 | A * | 6/1975 | Cauffiel | 451/59 |
| 4,188,812 | A * | 2/1980 | Nomura et al. | 72/227 |
| 4,269,052 | A * | 5/1981 | Imai et al. | 72/39 |
| 5,472,579 | A * | 12/1995 | Mabuchi et al. | 205/709 |
| 5,554,235 | A * | 9/1996 | Noe et al. | 148/610 |
| 5,820,704 | A | 10/1998 | Veyer et al. | |
| 6,088,895 | A | 7/2000 | Nelson et al. | |
| 6,328,631 | B1 | 12/2001 | Fukano et al. | |
| 6,329,081 | B1 * | 12/2001 | Fudanoki et al. | 428/687 |
| 6,478,899 | B1 | 11/2002 | VogesLegrand et al. | |
| 6,537,398 | B1 | 3/2003 | Ljungars | |
| 6,814,815 | B2 | 11/2004 | Voges | |

FOREIGN PATENT DOCUMENTS

| | | | |
|---|---|---|---|
| CN | 1105298 | A | 7/1995 |
| CN | 1156065 | A | 8/1997 |
| CN | 1261560 | A | 8/2000 |
| CN | 1761537 | A | 4/2006 |

(Continued)

*Primary Examiner* — Edward Tolan
(74) *Attorney, Agent, or Firm* — The Webb Law Firm

(57) ABSTRACT

A method for continuously removing scale from a hot-rolled carbon steel strip includes: cracking the scale on the hot-rolled steel strip; shot-blasting the cracked scale to remove the scale; deforming the hot-rolled steel strip so as to weaken the bond between scale remaining after the shot-blasting and the hot-rolled steel strip and so as to impart surface roughness to the hot-rolled steel sheet; and polishing the deformed hot-rolled steel strip to remove the remaining scale.

6 Claims, 2 Drawing Sheets

(56) References Cited

FOREIGN PATENT DOCUMENTS

| | | | | | |
|---|---|---|---|---|---|
| CN | 1830589 | A | | 9/2006 | |
| JP | 55-30363 | A | * | 3/1980 | ..... B21B 45/04 |
| JP | 57142710 | A | | 9/1982 | |
| JP | 1273607 | A | | 11/1989 | |
| JP | 4-237504 | A | * | 8/1992 | ..... B21B 15/00 |
| JP | 04238619 | A | | 8/1992 | |
| JP | 04351221 | A | | 12/1992 | |
| JP | 05076923 | A | | 3/1993 | |
| JP | 7051724 | A | | 2/1995 | |
| JP | 8-20888 | | * | 1/1996 | ..... C25D 5/26 |
| JP | 10094817 | A | | 4/1998 | |
| JP | 2000233217 | A | | 8/2000 | |
| JP | 2002504434 | A | | 2/2002 | |
| JP | 2002275666 | A | | 9/2002 | |
| JP | 2002532633 | A | | 10/2002 | |
| JP | 2002371314 | A | | 12/2002 | |
| JP | 2003064461 | A | | 3/2003 | |
| JP | 2004074178 | A | | 3/2004 | |
| JP | 2004306077 | A | | 11/2004 | |
| JP | 2006521932 | A | | 9/2006 | |
| JP | 2007056358 | A | | 3/2007 | |
| KR | 100395288 | B1 | | 12/2003 | |

* cited by examiner

METHOD AND APPARATUS FOR REMOVING SCALE FROM HOT-ROLLED STEEL STRIP

TECHNICAL FIELD

The present invention relates to a method and apparatus for removing scale from hot-rolled steel strips, and more particularly, to a method and apparatus for continuously removing scale from hot-rolled carbon steel strips using a physical technique.

BACKGROUND ART

Hot-rolled carbon steel strips are produced by hot-rolling at high temperatures. On the surface of the hot-rolled steel strip, a scale layer having a thickness of several microns to several tens of microns is formed.

FIG. 1 shows an example of a process for descaling the hot-rolled steel strip according to the prior art. As shown therein, the scale on the hot-rolled steel strip is cracked by a scale breaker 3, and then chemically removed mainly using high-temperature strong acid, such as hydrochloric acid or sulfuric acid, in a pickling unit including a pickling bath 4 and a rinsing bath 5.

In FIG. 1, reference numerals 1, 2 and 10 indicate a payoff reel, a welder, and a tension reel, respectively.

However, this method for removing scale using strong acid has various problems, including the increase in the length of equipment, caused by the use of a number of pickling baths and rinsing baths, deterioration in the working environment, caused by the generation of acidic vapor, the occurrence of environmental hazards by waste acid treatment, the increase in accompanying facilities due to acid recovery and acid-resistant equipment, the difference in descaling ability between steel materials, deterioration in the quality of steel strips remaining too long in the acid solution and rinsing tanks during the stopping of a production line, etc.

As an alternative to this method for chemically removing scale using the acid solution, an attempt has been made to physically remove scale from the steel sheet surface by spraying shot balls, grit or a slurry mixture of shot balls or grit with water onto the steel sheet surface. Techniques related thereto may include Japanese Patent Publication Nos. 2002-532633, 2002-275666 and 2002-371314.

However, these techniques are mostly used together with a pickling process that is a pretreatment process for increasing the efficiency at which special steels such as stainless steel or electric steel sheets are pickled. Particularly, the application of these techniques to general carbon steels can hardly be seen.

In addition, Japanese Patent Publication No. 2004-74178 discloses a method of removing scale by spraying high-pressure water, and U.S. Pat. No. 6,328,631 discloses a method of spraying ice grains. However, the descaling performance of these methods and whether these methods can be used in practice are not clear.

Also, Japanese Patent Laid-Open No. 2003-064461 and U.S. Pat. No. 6,088,895 disclose techniques related to equipment in which said physical descaling process is continuously connected with a rolling or plating process, and a method for treating steel sheets using said equipment.

Japanese Patent Laid-Open No. 2003-064461 merely proposes a tension leveler or a shot-blasting method as a subsidiary means for pickling, and does not specifically mention shot blasting.

U.S. Pat. No. 6,088,895 discloses a method comprising the steps of tension-leveling and shot-blasting a metal strip, subjecting the shot-blasted strip to two-step brushing to remove the scale, controlling the surface roughness of the strip within a predetermined range, and finely controlling the surface roughness to less than 0.3 microns in a subsequent cold-rolling process. The method disclosed therein aims to provide a cold-rolled stainless steel sheet having low surface roughness.

However, the scale on hot-rolled stainless steel sheets is dense and difficult to remove, and for this reason, it is difficult to remove the scale using only the method of said US patent. In fact, the method of said US patent is used in combination with an acid pickling process.

SUMMARY OF THE INVENTION

An aspect of the present invention provides a method and apparatus for removing scale from a hot-rolled carbon steel strip, which can sufficiently descale the hot-rolled carbon steel strip using a physical means and, at the same time, can ensure excellent surface roughness of the hot-rolled carbon steel strip.

According to one aspect of the present invention, there is provided a method for continuously removing scale from a hot-rolled carbon steel strip, the method including: cracking the scale on the hot-rolled steel strip; shot-blasting the cracked scale to remove the scale; deforming the hot-rolled steel strip so as to weaken the bond between scale remaining after the shot-blasting and the hot-rolled steel strip and to impart surface roughness to the hot-rolled steel sheet; and polishing the deformed hot-rolled steel strip to remove the remaining scale.

According to another aspect, there is provided an apparatus for continuously removing scale from a hot-rolled carbon steel strip, the apparatus including: a cracking unit for cracking the scale on the hot-rolled steel strip; a shot-blasting unit placed behind the cracking unit and serving to shot-blast the cracked scale so as to remove the scale; a steel strip-deforming unit placed behind the shot-blasting unit and serving to deform the hot-rolled steel strip so as to weaken the bond between scale remaining after passage through the shot-blasting unit and the hot-rolled steel sheet and so as to impart surface roughness to the hot-rolled steel strip; and a polishing unit placed behind the steel strip-deforming unit and serving to polish the hot-rolled steel strip, passed through the steel strip-deforming unit, so as to remove the remaining scale.

In the present invention, the amount of scale removed by shot-blasting is preferably 60% or more, and more preferably about 80-95%.

As described above, according to the present invention, a hot-rolled steel strip is continuously descaled using a physical method. Thus, the present invention offers the following advantages: preventing the generation of acidic steam; omitting or greatly reducing acid recovery or waste acid treatment processes; reducing the length of equipment; and reducing the production cost. In addition, the present invention has the effects of controlling the surface roughness of the steel strip during the descaling process so as to satisfy the customer's requirement; improving the surface quality of the steel strip; and reducing the defective rate caused by the stop of the production line.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
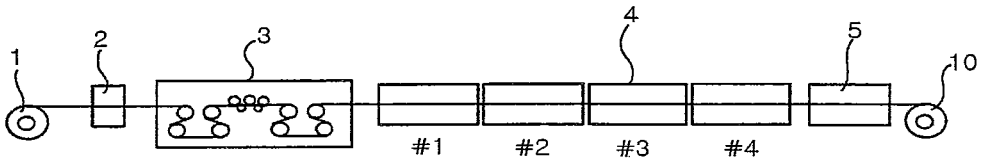
FIG. 1 (Prior Art)
FIG. 1 is a schematic view showing a continuous pickling process according to the related art.

Hereinafter, the present invention will be described in detail.

The present invention relates to a technique for descaling a hot-rolled carbon steel strip, which can remove scale from the hot-rolled carbon steel strip using a physical descaling technique in place of a pickling process, and also which controls the surface roughness of the hot-rolled carbon steel strip, which could not be achieved by a conventional physical descaling technique. It is more advantageous in terms of environmental issues, economic efficiency and surface quality, as compared to the techniques of the related art.

The key technical concept of the present invention is that general hot-rolled carbon steel strips are descaled by cracking the scale on the steel strip using, for example, a scale breaking unit, spraying shot balls uniformly onto the surface of the steel strip, having the scale layer, at high speed in the width direction of the steel strip, to remove the majority of the scale, deforming the descaled steel strip to weaken the bond between the remaining scale and the steel strip and control the surface roughness of the steel strip, and removing the remaining scale using a polishing unit of, for example, a brush roll type. The present invention can substitute for the conventional pickling process and, at the same time, can effectively control the surface roughness of hot-rolled steel strips.

In the present invention, in order to increase the rate at which a hot-rolled steel strip is descaled, the steel strip may also be subjected to auxiliary polishing or pickling, following shot blasting, using an auxiliary polishing or pickling unit placed behind the shot-blasting unit.

Examples of hot-rolled steel strips that may be used in the present invention include hot-rolled carbon steel strips, such as low carbon steels, ultra-low carbon steels, high-strength carbon steels, and high carbon steels.

The high-strength carbon steels may include high-strength carbon steels containing alloying elements, such as manganese and silicon.

The hot-rolled carbon steel strip that is used in the present invention has a soft property as compared to stainless steel, and shows a great change in surface roughness, caused by shot blasting, as compared to stainless steel.

If the hot-rolled carbon steel strip that is used in the present invention is treated with a two-step polishing brush such as that described in U.S. Pat. No. 608,895 to control the surface roughness and to remove the remaining scale, the surface thereof can be scratched by the use of the strong polishing brush, and such scratches will appear even in subsequent processes, and the removal of nail-like fine scales will also not be effectively achieved.

For this reason, the invention disclosed in U.S. Pat. No. 608,895 cannot be effectively applied to hot-rolled carbon steel strips to which the present invention is applied, and the application thereof will be limited to hard hot-rolled steel strips such as stainless steel.

Accordingly, the present invention provides a method and an apparatus, which are suitable for descaling hot-rolled carbon steel strips, in view of the properties of the descaling hot-rolled carbon steel strips and the properties of the scale formed thereon.

In order to remove scale from a hot-rolled steel strip according to the present invention, it is required to carry out a cracking process using a cracking unit to crack the scale formed on the hot-rolled steel strip.

As the cracking unit, any unit may be used without any particular limitation, as long as it physically cracks the scale of the hot-rolled steel strip. A conventional scale breaker may be used as the cracking unit.

The scale breaker is a device that stretches and bends a hot-rolled steel strip to crack the scale.

If the scale breaker is used, as the elongation and amount of bending thereof increase, the effect of cracking the scale layer increases, but excessive elongation can damage the properties of the hot-rolled steel strip. For this reason, preferably, the elongation is 0.5-3.0%, and the amount of bending is 10-50 mm.

At an elongation of less than 0.5% and an amount of bending of less than 10 mm, the effect of cracking the scale can be insignificant, and at an elongation of more than 3% and an amount of bending of 50 mm, the hot-rolled steel strip can become hard and be excessively deformed.

Then, the cracked scale is shot-blasted using a shot-blasting unit to remove the scale.

Herein, the amount of scale removed is more than 60% of the total amount of scale to be removed, and preferably 80-95%, although it may also be may be suitably controlled by a subsequent process.

The amount of scale removed may vary depending on the line speed of the hot-rolled steel strip and the number of shot blasting chambers.

In the shot blasting process, shot balls are sprayed uniformly on the surface of the flattened hot-rolled steel strip in the width direction to remove the scale. 2-6 shot blasting chambers may be used depending on the line speed of the hot-rolled steel strip.

Conditions for carrying the shot blasting process are not specifically limited, but preferred conditions are as follows: shot ball diameter: 0.3-0.8 mm; spraying speed of shot balls: 60-78 m/sec; and amount of shot balls sprayed: 800-1200 kg/min.

If the diameter of the shot balls is smaller than 0.3 mm, the effect of removing the scale will be insufficient, and if it is greater than 0.8 mm, the surface roughness of the steel strip will be excessively increased, making it difficult to control the surface roughness in subsequent processes.

The average surface roughness of the steel strip after shot blasting is preferably controlled to be within the range of 2.0-5.0 μm in terms of the effect of scale removal and the control of surface roughness.

After the shot blasting process, the hot-rolled steel strip is suitably deformed using a steel strip-deforming unit to weaken the bond between scale remaining after passage through the shot blasting process and the steel strip and, at the same time, impart surface roughness to the steel strip.

Herein, the average surface roughness of the hot-rolled steel sheet can be suitably controlled to be within the range of 0.5-3.0 μm.

As the steel strip-deforming unit, any unit may be used as long as it can weaken the bond between the remaining scale and the hot-rolled steel sheet and, at the same time, impart surface roughness to the steel strip. Preferably, a skin-pass roll may be used.

For example, if the skin-pass roll is used, the reduction ratio of the steel strip is preferably about 0.5-3.0% in order to obtain an average surface roughness of 0.5-3.0 μm.

After the shot blasting process, but before the steel strip-deforming process, an auxiliary polishing or pickling process may also be carried out.

The auxiliary polishing is carried out to a small extent compared to the polishing process which is carried out immediately after the steel strip-deforming process, and the pickling process is optionally carried out.

Next, the hot-rolled steel strip, passed through the steel strip-deforming process, is polished to remove the remaining scale.

The steel strip-deforming process makes the surface of the steel strip smoother, and thus can more improve the effect of removing the remaining scale in the polishing process.

In addition, the polishing process also has the effect of making the surface roughness more uniform.

The polishing process is preferably carried out using a polishing unit consisting of 2-6 serially arranged pairs of brush rolls facing each other vertically, but the polishing unit is not specifically limited. The brush roll is preferably made of a nylon resin containing abrasive particles, such as silicon carbide or aluminum oxide, to which polyurethane or phenol-based resin may be added to increase the adhesive strength and polishing effect of the abrasive particles.

The brush roll preferably has a roughness of #100-#240 (on a mesh number basis) depending on the ability to removal the remaining scale and the surface roughness required in the steel sheet.

When the polishing process is carried out using the brush rolls, the brush rolls are preferably used at a revolution speed of 600-1200 rpm.

The hot-rolled steel sheet polished as described above can easily rust when exposed to the air, and for this reason, the steel sheet may, if necessary, be treated with rust preventive oil to prevent rusting of the steel sheet.

Hereinafter, the apparatus for removing scale from a hot-rolled carbon steel strip according to the present invention will be described in detail with the accompanying drawings.

Figure 2:
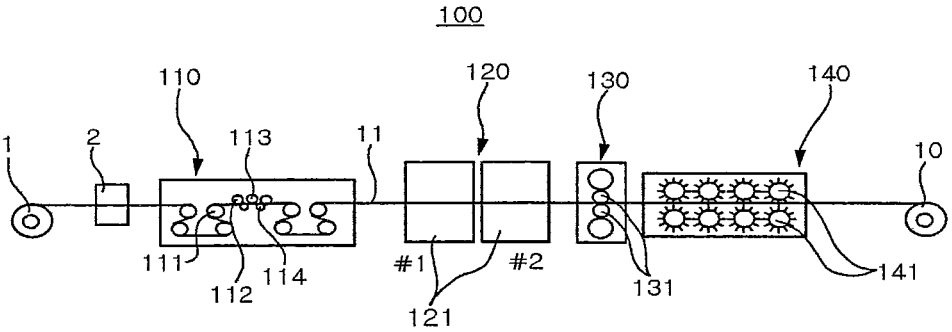
FIG. 2 is a schematic view showing an example of an apparatus for continuously removing scale from a hot-rolled carbon steel strip according to the present invention.

FIG. 2 shows an example of an apparatus for removing scale from a hot-rolled carbon steel strip according to the present invention.

As shown in FIG. 2, an apparatus 100 for removing scale from a hot-rolled steel strip is used to continuously remove scale from a hot-rolled carbon steel strip 11. The apparatus 100 of the present invention comprises: a cracking unit 110 for cracking the scale formed on the hot-rolled steel strip 11; a shot blasting unit 120 placed behind the cracking unit 110 and serving to shot-blast the cracked scale so as to remove the scale from the hot-rolled steel sheet 11; a steel strip-deforming unit 130 placed behind the shot blasting unit 120 and serving to deform the hot-rolled steel sheet 11 so as to weaken the bond between scale remaining after passage through the shot blasting unit and the hot-rolled steel strip 11 and, at the same time, impart surface roughness to the hot-rolled steel strip 11; and a polishing unit 140 placed behind the steel strip-deforming unit 130 and serving to polish the hot-rolled sheet strip 11, passed through the steel strip-deforming unit 130, so as to remove the remaining scale.

The cracking unit 110 in FIG. 2 is a conventional scale breaker which can impart bending to the steel strip under a specific tension. It comprises a tension bridle roll 111, an anti-camber roll 112, a leveler roll 113 and a bending roll 114, which can impart tension and elongation, in which the anti-camber roll 112 and the leveler roll 113 serve to flatten the shape of the hot-rolled steel strip.

The shot blasting unit 120 is configured to spray shot balls uniformly onto the surface of the flattened hot-rolled steel strip and includes shot blasting chambers 121 in which shot blasting is carried out. It preferably includes 2-6 shot blasting chambers depending on the line speed of the hot-rolled steel strip.

FIG. 2 illustrates an example in which the number of the shot blasting chambers 121 is 2.

The shot balls that are used in the present invention are not specifically limited, and preferably have a diameter of 0.3-0.8 mm.

As the steel strip-deforming unit 130, any unit may be used, as long as it can placed behind the shot blasting unit 120 and can deform the hot-rolled steel sheet 11 so as to weaken the bond between scale remaining after passage through the shot blasting unit and the hot-rolled steel strip 11 and, at the same time, impart surface roughness to the hot-rolled steel strip 11.

An example of the steel strip-deforming unit 130 may be a roller unit including a pair of rolls 131 having surface roughness. A skin-pass roller as shown in FIG. 2 may be preferable.

The surface roughness of the steel strip-deforming unit (roll) 130, which come into contact with the hot-rolled steel sheet, are preferably formed such that the steel strip-forming process imparts an average surface roughness of 0.5-3.0 μm to the hot-rolled steel strip.

The polishing unit 140 has a plurality of rotatable brush rolls 141, in which the brush rolls 141 are paired to face each other up and down, the number of pairs of the brush rolls 141 is 2-6, and the pairs of the brush rolls are arranged in series.

FIG. 2 illustrates the polishing unit 140 having 4 pairs of the brush rolls 141.

The brush rolls 141 are preferably made of a nylon resin containing abrasive particles such as silicon carbide or aluminum oxide, to which a polyurethane- or phenol-based resin may be added in order to increase the adhesive strength and polishing strength of the abrasive particles.

The roughness of the brush roll 141 is suitably selected depending on the ability to remove the remaining scale and the surface roughness required in the steel sheet, but is preferably set to be within the range of #100-#240 (on a mesh number basis).

The brush rolls 141 are preferably configured such that they can rotate at high speed in the same direction or an opposite direction with respect to the movement of the hot-rolled steel sheet 11.

If the brush rolls 141 are rotated in the direction opposite the movement of the hot-rolled steel strip 11, the effect of removing the scale will be excellent, while if they are rotated in the same direction as the movement of the hot-rolled steel strip 11, the effect of controlling uniformity of the surface roughness of the steel strip can be obtained.

In FIG. 2, reference numeral "1" indicates a payoff reel, reference "2" a welder, and reference numeral "10" a tension reel.

Figure 3:
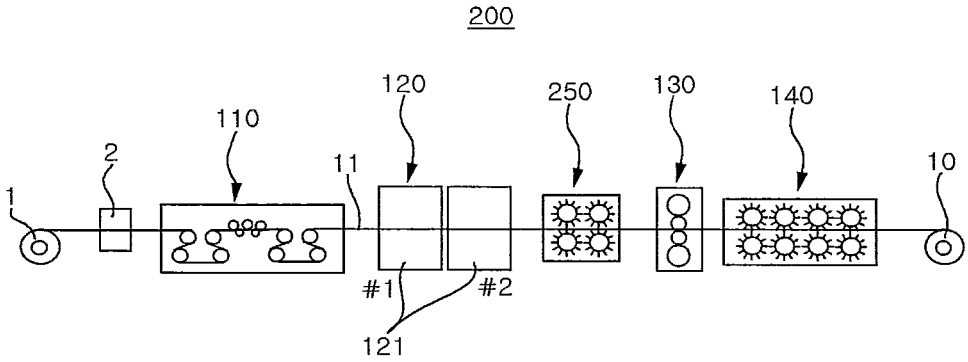
FIG. 3 is a schematic view showing another example of an apparatus for continuously removing scale from a hot-rolled carbon steel strip according to the present invention.
Figure 4:
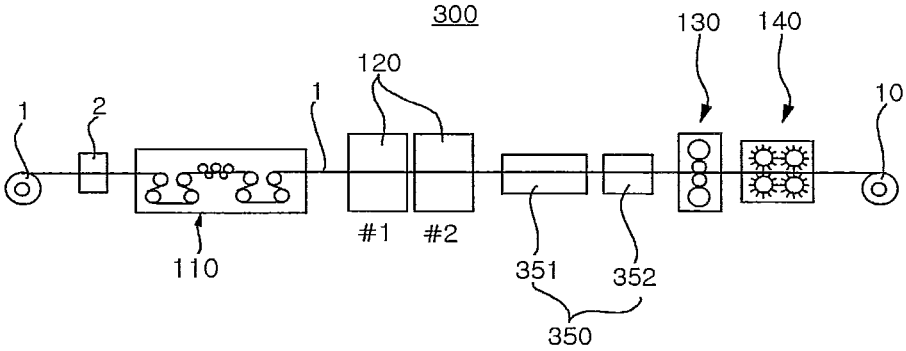
FIG. 4 is a schematic view showing still another example of an apparatus for continuously removing scale from a hot-rolled carbon steel strip according to the present invention.

FIGS. 3 and 4 show other examples of the apparatus for removing scale from hot-rolled carbon steel strips according to the present invention.

An apparatus 200 for removing scale from a hot-rolled steel strip, shown in FIG. 3, additionally comprises an auxiliary polishing unit 250 between the shot blasting unit 120 and the steel strip-deforming unit 130.

The polishing ability of the auxiliary polishing unit 250 may be lower than that of the polishing unit 140.

Meanwhile, an apparatus 300 for removing scale from a hot-rolled steel strip, shown in FIG. 4, additionally comprises an auxiliary pickling unit 350 between the shot blasting unit 120 and the steel strip-deforming unit 130.

The auxiliary pickling unit 350 includes a pickling bath 351 and a rinsing bath 352, wherein the number of the pickling baths 351 is preferably 1-3.

If the auxiliary polishing unit 250 or the auxiliary pickling unit 350 is provided, the ability to remove scale remaining after the shot blasting process can enhanced, making it possible to increase the line speed of the hot-rolled steel strip, and the load of subsequent processes can be reduced.

Hereinafter, the method of removing scale from hot-rolled steel strips using the apparatus of FIG. 2 will be described.

As can be seen in FIG. 2, processes for removing scale from a hot-rolled steel strip are continuously carried out. First, the coiled hot-rolled steel strip 11 is released from the payoff reel 1 and is welded with the preceding hot-rolled steel strip 11 by the welder 1 and continuously travels.

During welding between the hot-rolled steel strips 11, the steel sheets 11 stop, and if a looper (not shown) is placed between the welder 2 and the cracking 110, the steel strip will continuously travel during subsequent processes.

When the steel strip is tensioned in the cracking unit 110 and bent by the bending roll, a large number of cracks occur in the scale layer formed on the surface of the steel sheet, and the amount of cracks occurred increases as the elongation and the amount of bending increase.

However, excessive elongation can damage the properties of the hot-rolled steel sheet. For this reason, preferably, the elongation is set at 0.5-3.0%, and the amount of bending is set at 10-50 mm. At an elongation of less than 0.5% and an amount of bending of less than 10 mm, the cracking effect will be insignificant, and at an elongation of more than 3% and an amount of bending of more than 50 mm, the steel strip can become hard and be excessively deformed.

If a large amount of cracks are formed in the scale layer, the removal of scale by the subsequent shot blasting unit 120 will be easy, such that 80-95% of the scale can be removed, and the surface roughness of the hot-rolled steel strip can be controlled within a specific range by optimizing shot blasting conditions such as the size of shot balls.

Preferred conditions for shot blasting are as follows: the diameter of shot balls: 0.3-0.8 mm; the spraying speed of shot balls: 60-78 m/sec; and the amount of shot balls sprayed: 800-1200 kg/min.

The amount of scale to be removed in the shot blasting process is more than 60% of the total amount of scale to be removed, and preferably about 80-95%, depending on the line speed of the steel strip, the number of the shot blasting chambers and the shot blasting conditions.

If the diameter of the shot balls is smaller than 0.3 mm, the efficiency of scale removal will be insufficient, and if it is greater than 0.8 mm, the surface roughness of the steel strip will excessively increase, making it difficult to control the surface roughness of the steel strip, and an excessive reduction ratio will be required in a subsequent temper mill process.

The average surface roughness of the steel strip after shot blasting is preferably set in the range of 2.0-5.0 μm in view of the scale removal effect and the control of surface roughness.

Then, the hot-rolled steel strip is suitably deformed using the steel strip-deforming unit 130, thereby weakening the bond between scale remaining after the shot blasting process and the steel strip while imparting surface roughness to the hot-rolled steel strip 11.

If the hot-rolled steel strip 11 is deformed using the steel strip-deforming unit 130 as described above, the surface roughness of the steel strip can be finely and uniformly controlled and the scale remaining on the surface of the steel strip can be effectively removed in the subsequent polishing process using the polishing unit 140.

Herein, the average surface roughness of the hot-rolled steel sheet 11 can be selectively controlled within the range of 0.5-3.0 μm.

As shown in FIG. 2, when the skin-pass roller is used as the steel strip-deforming unit 130, the reduction ratio of the steel strip in the steel strip-deforming process is preferably about 0.5-3.0% in order to obtain an average surface roughness of 0.5-3.0 μm.

Next, the hot-rolled steel strip, passed through the steel strip-deforming unit, is polished using the polishing unit 140.

In the polishing unit 140, although the revolution speed of the brush rolls 141 is not specifically limited, the brush rolls 141 are preferably rotated at a revolution speed of 600-1200 rpm.

In order to enhance the scale removal effect, the brush rolls 141 are preferably rotated in a direction opposite the movement of the hot-rolled steel strip 11, and in order to increase the effect of controlling the uniformity of surface roughness, the brush rolls 141 are preferably rotated in the same direction as the movement of the hot-rolled steel sheet 11.

The roughness of the brush rolls is expressed by a mesh number (number of pores per square inch). To obtain fine surface roughness, it is advantageous to use soft brush rolls, but if excessively soft brush rolls are used, the effect of removing the remaining scale will be reduced. For this reason, it is necessary to select brush rolls of suitable roughness, and it is preferable to use brush rolls having a roughness of #100~#240 (on a mesh number basis).

The surface roughness of the descaled hot-rolled steel strip varies, depending on the customer's requirement or subsequent processes such as cold rolling or plating. Also, because the descaled hot-rolled steel strip can easily rust in the air, it is treated with rust preventive oil, if necessary.

Meanwhile, as shown in FIGS. 3 and 4, if the auxiliary polishing unit 250 or the auxiliary pickling unit 350 is provided, the ability to remove scale remaining after the shot blasting process can be enhanced, making it possible to increase the line speed of the hot-rolled steel strip, and the load of the subsequent processes can be reduced.

As described above, the hot-rolled steel strip 11 can be effectively descaled without using an acid solution by sequentially passing the steel strip through the cracking unit 110 and the shot blasting unit 120 of the inventive apparatus, and, if necessary, passing the steel strip through the auxiliary polishing unit 240 or the auxiliary pickling unit 350, and then passing the steel strip through the steel strip-deforming unit 130 and the polishing unit 140. In addition, the surface roughness of the steel strip can be suitably controlled by selecting a suitable combination of conditions for carrying out shot blasting, steel strip deformation and brushing.

Hereinafter, the present invention will be described in further detail with reference to examples. It is to be understood, however, that these examples are illustrative purposes only and not to be construed as limiting the scope of the present invention.

EXAMPLE 1

A hot-rolled low-carbon steel strip (2.5 mm thickness× 1200 mm width) containing 0.04 wt % C, 0.02 wt % Mn and 0.01 wt % Si was continuously passed through the descaling apparatus of FIG. 2 at a line speed of 40 mpm under the conditions shown in Table 1 below. As a result, the steel strip had a remaining scale level of less than 1%, similar to a pickled hot-rolled steel strip according to the related art, and also had an average surface roughness of about 0.8 μm (about 1.2-1.5 μm for the pickled steel strip) and excellent surface gloss.

TABLE 1

| | Treatment Conditions |
|---|---|
| Scale breaking | Elongation: 1.2%<br>Amount of bending: 20 mm |
| Shot blasting | Two shot blasting chambers<br>Shot ball size: 0.3-0.5 mmΦ<br>Spraying speed of shot balls: 70 m/sec<br>Amount of shot balls sprayed: 1200 kg/min |
| Steel strip deformation | Average roughness of roll: 0.6 μm<br>Reduction ratio: 1.5% |
| Polishing | Four pairs of brush rolls (two pairs of front rolls: #120, two pairs of rear rolls: #180)<br>Revolution speed: 1000 rpm |

EXAMPLE 2

A high-strength hot-rolled steel strip (3.0 mm thickness× 1200 mm width) containing 0.1 wt % C, 1.7 wt % Mn and 0.5 wt % Si was continuously passed through the descaling apparatus of FIG. 3 at a line speed of 50 mpm under the treatment conditions shown in Table 2 below. As a result, the steel strip had a remaining scale level of less than 1%, similar to a pickled hot-rolled steel strip according to the related art, and also had an average surface roughness of less than 1.5 μm and excellent surface gloss. Also, in the steel strip, surface defects caused by scale were reduced.

TABLE 2

| | Treatment Conditions |
|---|---|
| Scale breaking | Elongation: 1.5%<br>Amount of bending: 30 mm |
| Shot blasting | Two shot blasting chambers<br>Shot ball size: 0.3-0.5 mmΦ<br>Spraying speed of shot balls: 78 m/sec<br>Amount of shot balls sprayed: 1200 kg/min |
| Primary (auxiliary) polishing | Two pairs of brush rolls (#100)<br>Revolution speed: 800 rpm |
| Steel strip deformation | Average roughness of roll: 1.0 μm<br>Reduction ratio: 1.0% |
| Secondary polishing | Four pairs of brush rolls (2 pairs of front rolls: #120, two pairs of rear rolls: #180)<br>Revolution speed: 1000 rpm |

EXAMPLE 3

A hot-rolled low-carbon steel strip (6.0 mm thickness× 1000 mm width) containing 0.04 wt % C, 0.02 wt % Mn and 0.01 wt % Si was continuously passed through the descaling apparatus of FIG. 4 at a line speed of 50 mpm under the conditions shown in Table 3 below. As a result, the steel strip had a remaining scale level of less than 1%, similar to a pickled hot-rolled steel strip according to the related art, and also had an average surface roughness of about 2.5 μm and excellent surface gloss.

TABLE 3

| | Treatment Conditions |
|---|---|
| Scale breaking | Elongation: 1.2%<br>Amount of bending: 30 mm |
| Shot blasting | Two shot blasting chambers<br>Shot ball size: 0.4-0.7 mmΦ<br>Shot ball spraying speed: 70 m/sec<br>Amount of shot balls sprayed: 1200 kg/min |
| Pickling | One pickling bath (length: 1.5 m)<br>Hydrochloric acid concentration: 15%<br>Temperature: 60° C. |
| Steel strip deformation | Average roughness of roll: 1.5 μm<br>Reduction ratio: 1.0% |
| Polishing | Two pairs of brush rolls (#100)<br>Revolution speed: 800 rpm |

While the present invention has been shown and described in connection with the exemplary embodiments, it will be apparent to those skilled in the art that modifications and variations can be made without departing from the spirit and scope of the invention as defined by the appended claims.

The invention claimed is:

1. A method for continuously removing scale from a hot-rolled carbon steel strip, the method comprising:

cracking the scale on the hot-rolled steel strip, wherein the cracking is carried out using a scale breaker, and wherein an elongation and an amount of bending of the scale breaker in the cracking are controlled to 0.5-3% and 10-50 mm, respectively;

shot-blasting the cracked scale to remove the scale, wherein an amount of scale removed in the shot-blasting is 80-95% of a total amount of scale to be removed, wherein a shot ball diameter, a shot ball sprag speed and an amount of shot balls sprayed in the shot-blasting, are controlled to 0.3-0.8 mm, 60-78 m/sec, and 800-1200 kg/min, respectively;

deforming the hot-rolled steel strip so as to weaken the bond between scale remaining after the shot-blasting and the hot-rolled steel strip and so as to impart surface roughness to the hot-rolled steel sheet, wherein the deforming of the hot-rolled steel strip is carried out using a skin-pass roller; and polising the deformed hot-rolled steel strip to remove the remaining scale, wherein the polishing is carried out using a plurality of rotatable brush rolls, wherein a roughness of the brush rolls in the polishing is #100~#240 on a mesh number basis, and wherein a revolution speed of the brush rolls is controlled to 600-1200 rpm.

2. The method of claim 1, wherein the brush rolls are paired to face each other vertically, and the pairs of the brush rolls are arranged in series.

3. The method of claim 1, wherein the hot-rolled steel strip is at least one selected from the group consisting of low-carbon steel, ultra-low carbon steel, a high-strength carbon steel containing alloying elements, including manganese and silicon, and high-carbon steel.

4. The method of claim 1, wherein deformation is imparted to the hot-rolled steel strip during the deforming of the steel strip such that the hot-rolled steel strip has an average roughness of 0.5-3.0 μm after the deforming of the steel strip.

5. The method of claim 1, wherein the method additionally comprises an auxiliary polishing or an auxiliary pickling between the shot-blasting and the deforming of the steel strip.

6. A method of manufacturing a steel strip, comprising:

hot-rolling a carbon steel strip; and performing the method for continuously removing scale from the hot-rolled carbon steel strip according to claim 1.

* * * * *

UNITED STATES PATENT AND TRADEMARK OFFICE

CERTIFICATE OF CORRECTION

PATENT NO. : 8,806,910 B2
APPLICATION NO. : 13/001522
DATED : August 19, 2014
INVENTOR(S) : Jin et al.

It is certified that error appears in the above-identified patent and that said Letters Patent is hereby corrected as shown below:

In the Claims

Column 10, Line 34, Claim 1, delete “sprag” and insert -- spraying --

Column 10, Line 34, Claim 1, delete “speed” and insert -- speed, --

Column 10, Line 35, Claim 1, delete “sprayed” and insert -- sprayed, --

Column 10, Line 45, Claim 1, delete “polising” and insert -- polishing --

Signed and Sealed this
Sixteenth Day of December, 2014

Michelle K. Lee

Michelle K. Lee
*Deputy Director of the United States Patent and Trademark Office*